United States Patent [19]

Leppänen

[11] Patent Number: 4,721,171

[45] Date of Patent: Jan. 26, 1988

[54] OPENING DEVICE FOR DRILL RODS FOR AN EXTENSION ROD DRILLING EQUIPMENT

[75] Inventor: Jarmo Leppänen, Ylöjärvi, Finland

[73] Assignee: Oy Tampella Ab, Tampere, Finland

[21] Appl. No.: 911,783

[22] Filed: Sep. 26, 1986

[30] Foreign Application Priority Data

Oct. 22, 1985 [FI] Finland ..... 854120

[51] Int. Cl.[4] ..... E21B 3/00

[52] U.S. Cl. ..... 173/164; 81/57.16

[58] Field of Search ..... 173/164; 81/57.16, 57.33; 175/85; 166/77.5

[56] References Cited

U.S. PATENT DOCUMENTS

| | | | |
|---|---|---|---|
| 3,832,918 | 9/1974 | Lang et al. | 81/57.33 |
| 3,851,714 | 12/1974 | Visser et al. | 173/164 |
| 4,445,402 | 5/1984 | Farr et al. | 173/164 |
| 4,497,224 | 2/1985 | Jurgens | 81/57.16 |
| 4,591,005 | 5/1986 | Paivalainen et al. | 173/164 |

FOREIGN PATENT DOCUMENTS

| | | |
|---|---|---|
| 1775409 | 10/1971 | Fed. Rep. of Germany . |
| 1302109 | 1/1973 | United Kingdom . |

*Primary Examiner*—Paul A. Bell
*Assistant Examiner*—James L. Wolfe
*Attorney, Agent, or Firm*—Nixon & Vanderhye

[57] ABSTRACT

An opening device for drill rods for an extension rod drilling equipment, which device comprises a drilling machine (2) displaceable along a feeding beam (1), a stationary drill rod retaining centralizer (3) positioned on the drilling axis (A) for the drill rod, and a drill rod gripping centralizer (4) positioned between the retaining centralizer and the drilling machine. In order to speed up the disconnection of the drill rods, and in order to simplify the structure, the retaining centralizer is provided with a rotating mechanism (15) for the rotation thereof and the gripping centralizer is connected to an actuating device (22) for the displacement thereof in the direction of a drilling axis (A).

5 Claims, 12 Drawing Figures

OPENING DEVICE FOR DRILL RODS FOR AN EXTENSION ROD DRILLING EQUIPMENT

Figure 2:
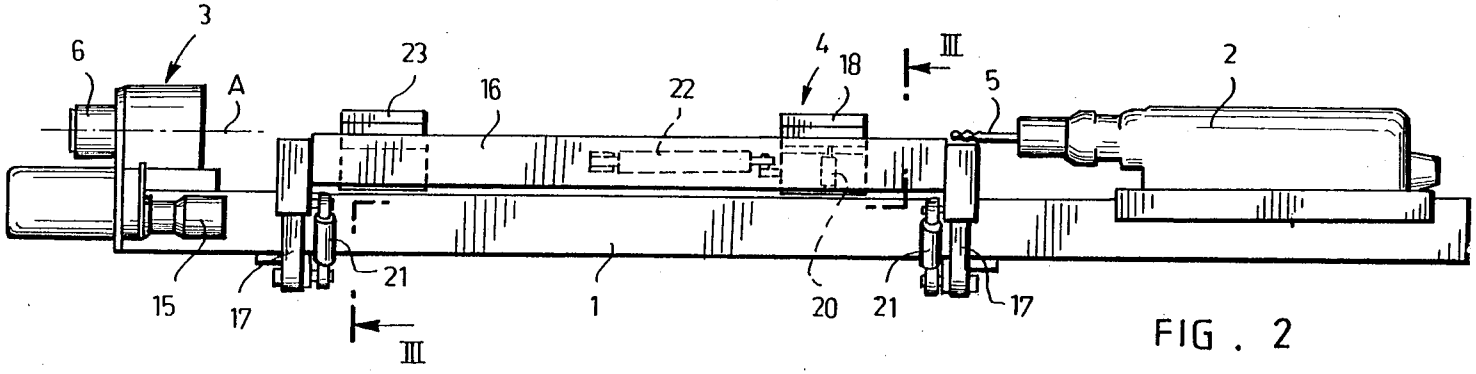

This invention relates to an opening device for drill rods for an extension rod drilling equipment, comprising a feeding beam, a drilling machine displaceable along the feeding beam, a retaining centralizer for a drill rod, which centralizer is supported on the feeding beam and positioned on a drilling axis, a rotating mechanism for the rotation of the drill rod, and a gripping centralizer for the drill rod, which centralizer is positioned between the retaining centralizer and the drilling machine.

In mechanized extension rod drilling, separate drill rods are connected and disconnected by means of special opening devices which are used together with retaining centralizers. The retaining centralizer is stationarily positioned at the opposite end of the feeding beam with respect to the drilling machine, and it is intended on one hand to guide the drill rod when starting the drilling and on the other hand to grip the drill rod and retain it when the drilling machine or the drill rod is being disconnected. The opening device is intended to lock the drill rod so that it is unrotative when the drill rod is to be rotated off the shank and to rotate the drill rod when it is to be rotated off a drill rod retained by the retaining centralizer.

It is previously known to use a separate rotating mechanism as an opening device, which mechanism is displaced to the drilling axis from the side of the feeding beam together with a separate gripping centralizer positioned between the retaining cenralizer and the drilling machine. The rotating mechanism is thereby displaceable in the direction of the drilling axis at least over a distance corresponding to the length of the threading of the drill rod, whereas the retaining centralizer is stationary in the drilling direction.

However, this kind of opening device disadvantageous in that the rotating mechanism requires plenty of space a the side of the feeding beam and is heavy on account of the rotating rolls thereof.

U.S. Pat. No. 3,851,714, British Patent Specification No. 1,302,109 and German Offenlegungsschrift No. 1,775,409 disclose different kinds of opening devices which are connected to a drilling machine to be displaced therewith and by means of which a drill rod can be locked to the shank when the drill rod is rotated by the drilling machine off a drill rod retained by the retaining centralizer.

A disadvantage of this kind of opening device is that it increases the mass of the drilling machine, is complicated in structure and liable to damage on account of the vibrations of the drilling machine.

The object of the present invention is to provide an opening device which avoids the above-mentioned disadvantages, is simpler in structure and lighter. This object is achieved by means of an opening device according to the invention which is characterized in that the rotating mechanism is connected to the stationary retaining centralizer for the rotation thereof, and that the gripping centralizer is provided with actuating means for the displacement of the gripping centralizer in the direction of said drilling axis.

The invention is based on the idea that instead of locking the drill rods positioned in the drill hole to be unrotative and rotating the drill rod positioned on the feeding beam for opening the threaded coupling therebetween, which is a prior procedure, the rods positioned in the drill hole are rotated and the drill rod positioned on the feeding beam is locked unrotative. Thereby the retaining centralizer, by means of which the drill rods are gripped anyway, is made rotative, whereby no separate rotating mechanism is needed and the structure becomes simpler as well as lighter. The retaining centralizer thus operates both as a gripping means and a rotating means, wherefore the opening device is rapid in operation. The opening device also enables the use of standard drill rods provided with sockets.

The structure of the opening device can be made very simple by constructing the retaining centralizer in such a manner that the rotation movement simultaneously automatically effects the gripping of the drill rod and the retaining thereof. One preferred embodiment for carrying out this kind of operation is described in applicant's co-pending application Serial No. 911,810 filed simultaneously with the present application.

Figure 1:
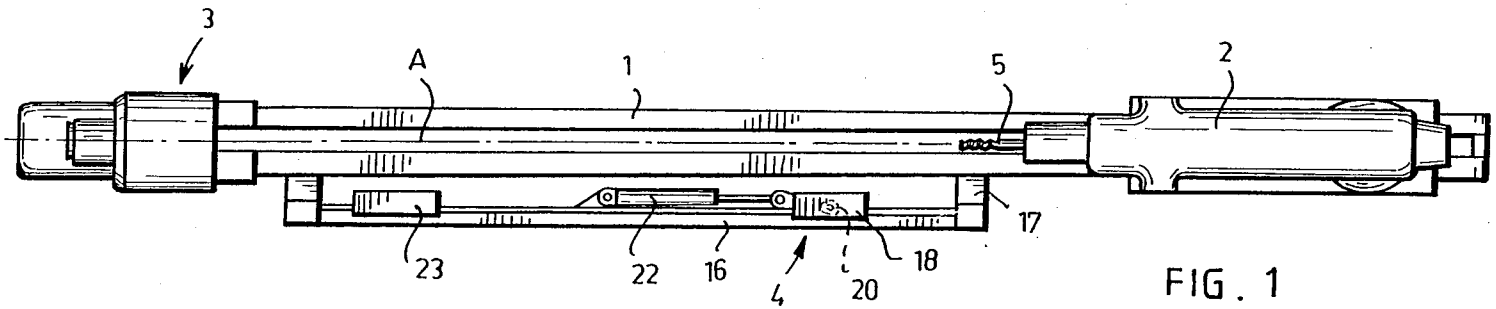
Figure 3:
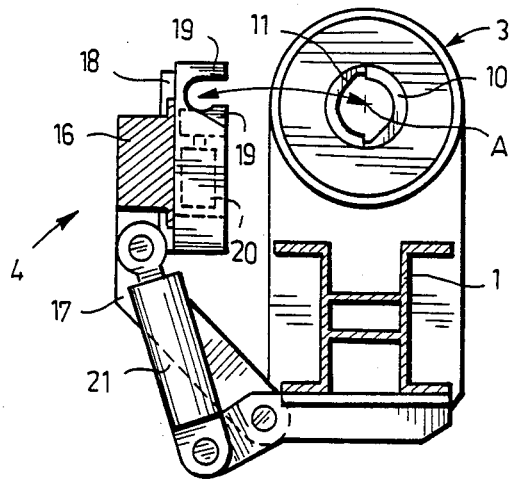
Figure 4:
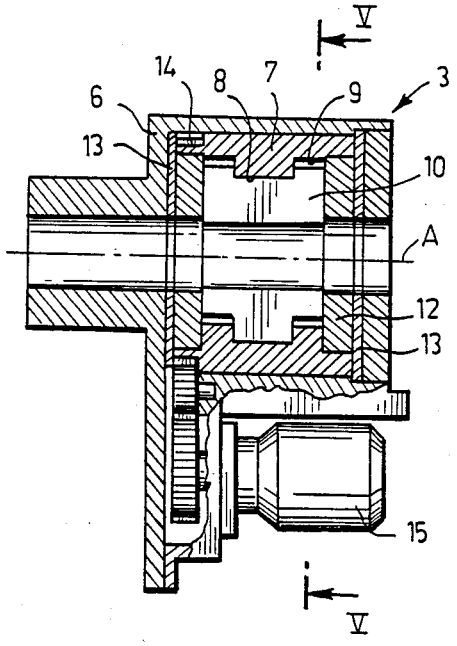
Figure 5:
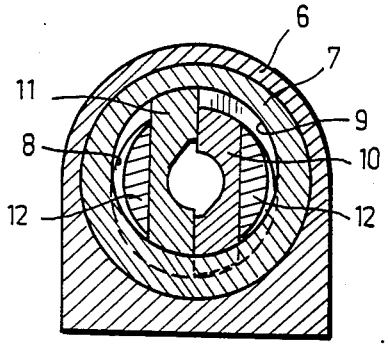

The invention will be described more closely below with reference to the attached drawings, wherein FIG. 1 is a schematical top view of a drilling equipment provided with an opening device according to the invention, FIG. 2 is a more detailed side view of the drilling equipment, FIG. 3 is a cross-sectional view of the gripping centralizer along line III—III in FIG. 2, FIG. 4 is an axial section of the retaining centralizer, FIG. 5 is a sectional view of the retaining centralizer along line V—V in FIG. 4, and FIGS. 6A to 6G are top views of different operational stages of the drilling equipment during the opening of a sequence of drill rods.

FIGS. 1 and 2 of the drawings show an extension rod drilling equipment which comprises an elongated feeding beam 1 and a drilling machine 2 displaceable therealong. A retaining centralizer 3 is mounted stationarily at one end of the feeding beam, and a gripping centralizer 4 at one side of the beam, whereby the opening device according to the invention is formed by said retaining centralizer and gripping centralizer. The guiding axis of the retaining centralizer is in a manner known per se positioned on the drilling axis A forming an extension of a shank 5 of the drilling machine.

The structure of the retaining centralizer 3 is described in more detail in FIGS. 4 and 5. A supporting sleeve 7 is rotatable mounted on a frame 6 fastened to the feeding beam, said supporting sleeve being provided with annular guideways 8, 9 positioned eccentrically with respect to the axis A of the retaining centralizer on opposite sides thereof. Separate plate-like jaws 10, 11 are mounted on the guideways to be pressed radially slideably against each other under the guidance of a supporting fork 12 mounted rotatably within the supporting sleeve. Friction plates 13 are mounted between the end surfaces of the frame and the ends of the supporting fork.

The outer periphery of the supporting sleeve is provided with a tooth rim 14, and a hydraulic rotation motor 15 is fastened on the frame, which motor is in engagement with the tooth rim through an intermediate coggwheel.

The arrangement is such that when the supporting sleeve is rotated within the frame, the guideways force the jaws to be displaced radially towards each other or away from each other, depending on the direction of rotation of the supporting sleeve, because the friction plates tend to resist the turning of the supporting fork and the jaws together with the supporting sleeve. When the rotating movement of the supporting sleeve continues, the jaws grip a drill rod extending through the supporting sleeve and are no longer able to move with respect to the supporting sleeve so that the jaws and the drill rod rotate together with the supporting sleeve.

The structure of the gripping centralizer 4 is shown in more detail in FIG. 3. The gripping centralizer comprises a supporting rail 16 which is pivotable mounted on the feeding beam in parallel therewith by means of pivot arms 17. The supporting rail supports a carriage 18 provided with jaws 19, one of which is fixed and the other is displaceable towards the fixed one by means of a hydraulic cylinder 20. Hydraulic cylinders 21 are provided for pivoting of the supporting rail, so that the jaws are displaceable to the drilling axis A and to the side of the feeding beam respectively by means of said cylinders 21. A hydraulic displacing cylinder 22 is mounted between the carriage and the supporting rail for the displacement of the carriage along the rail over a certain distance.

The supporting rail is further provided with a fixed intermediate centralizer 23 at a distance from the carriage 18 for supporting the drill rod.

Figure 6:
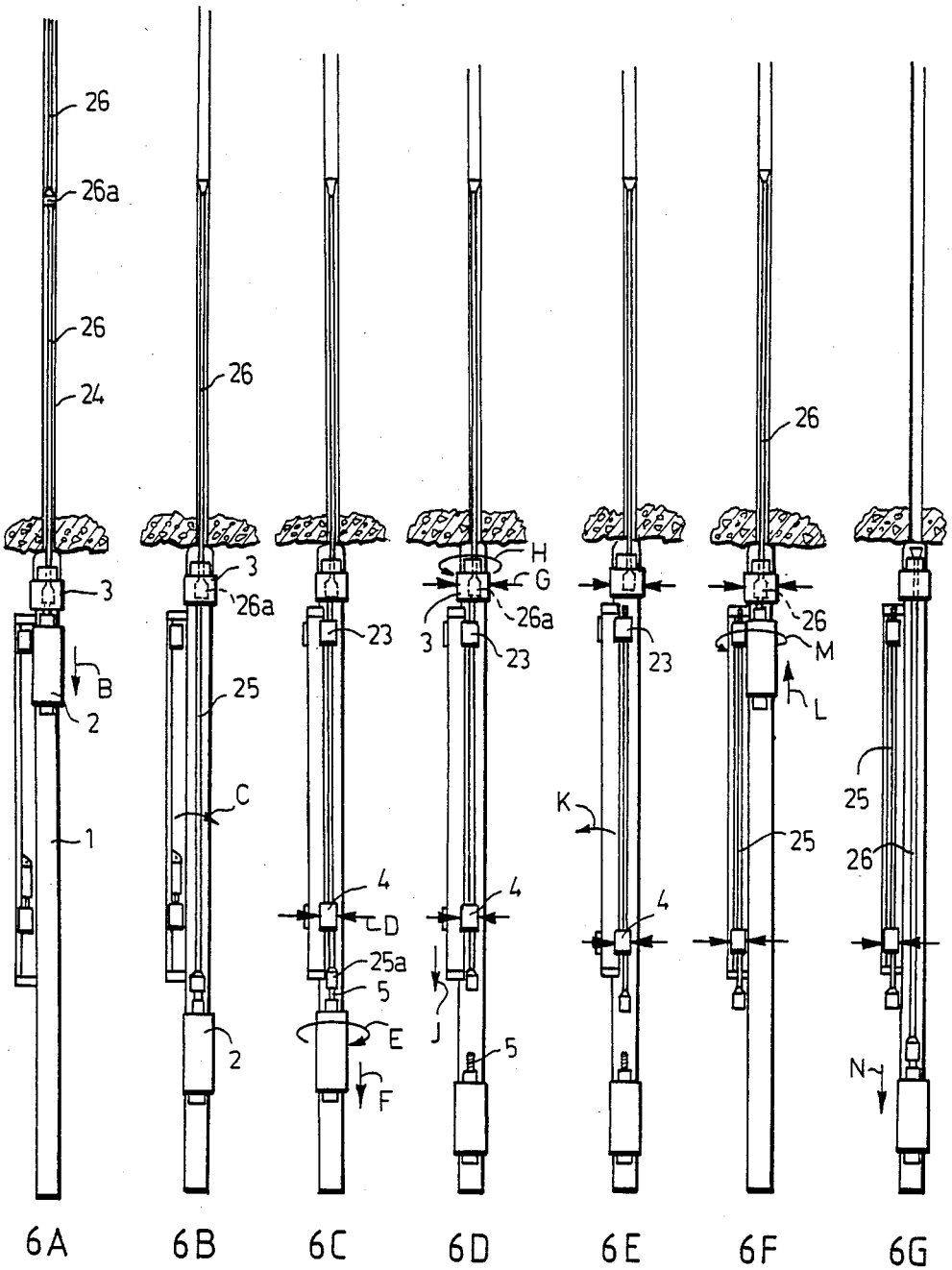

The opening device operates in the following way:

A hole 24 is drilled in the rock by the drilling machine 2 by means of drill rods 25 and 26. FIG. 6A.

The sequence of drill rods is drawn (B) out of the drill hole by displacing the drilling machine away from the rock so that a connecting socket **26*a* of the first rod 26 is positioned in level with the jaws 10, 11 of the retaining centralizer 3, FIG. 6B**.

The gripping centralizer 4 is pivoted (C) to the gripping position by means of the pivoting cylinders 21 so that the jaws 19 of the gripping centralizer and the intermediate centralizer 23 are positioned around the second drill rod 25. The jaws are locked (D) in engagement with the drill rod by means of the cylinder 20. The drilling machine is rotated (E) backwards so that the shank 5 is rotated off a connecting socket **25*a* of the second rod 25, FIG. 6C, and the drilling machine is displaced (F) to the retracted position. FIG. 6D**.

The jaws 10, 11 of the retaining centralizer 3 are locked (G) in engagement with a connecting socket **26*a* of the first drill rod 26 by rotating (H) the centralizer 3 so that the rod starts to rotate together with the cenralizer. The second rod 25, which is locked unrotative by means of the gripping centralizer 4 and is supported by the intermediate centralizer 23, is simultaneously displaced (J) together with the gripping centralizer by means of the displacing cylinder 22 axially away from the first rod. The first rod is thereby rotated off the second rod, which remains supported by the gripping centralizer and the intermediate centralizer, FIG. 6E**.

The gripping centralizer 4 is pivoted (K) to the side of the feeding beam by means of the pivoting cylinder 21, as a result of which the second drill rod is displaced away from the drilling axis A. The drilling machine is displaced (L) adjacent the retaining centralizer, and the shank is rotated (M) into engagement with the connecting socket **26*a* of the first rod, FIG. 6F**.

Thereafter the retaining centralizer is rotated in the opposite direction so that the first rod is released from the retaining centralizer. Finally, the drilling machine is displaced (N) to the initial position thereof so that the first rod is drawn out of the drill hole, FIG. 6G. The equipment is now ready to be displaced to a point where the next hole is to be drilled.

In order to speed up the process of disconnecting the sequence of rods, it is possible to rotate (E) the shank 5 off the connecting socket **25*a* of the second rod simultaneously as the connecting socket 26*a* of the first rod is rotated (H) off the second rod by rotating the retaining centralizer. The drilling machine is thereby drawn backwards more rapidly in synchronization with the movement of the displacing cylinder 22**.

The drawings and the description related thereto are only intended to illustrate the idea of the invention. In its details, the opening device according to the invention may vary within the scope of the claims. It is possible to arrange the gripping centralizer to co-operate with a rod casette into which the gripping centralizer delivers a drill rod released from the sequence of rods and wherefrom the gripping centralizer receives a drill rod to be fastened to the sequence of rods. If the drill rod is long, an additional intermediate centralizer can be provided between the retaining centralizer and the drilling machine for supporting of the rod during the drilling process. The intermediate centralizer can be of any suitable known structure.

I claim:

1. An opening device for drill rods in an extension rod drilling apparatus, comprising a feeding beam;

a drilling machine displaceable along the feeding beam;

a stationary retaining centralizer for a drill rod, said centralizer supported on the feeding beam and positioned along a drilling axis, said centralizer further including gripping means for gripping a drill rod within the retaining centralizer;

a drive mechanism;

a gripping centralizer for the drill rod, said gripping centralizer positioned between the retaining centralizer and the drilling machine, and wherein the drive mechanism is connected to the stationary retaining centralizer for actuating the gripping means and rotating the drill rod within the stationary retaining centralizer, and wherein the gripping centralizer is provided with a first actuating means for displacing the gripping centralizer in the direction of said drilling axis.

2. An opening device according to claim 1 wherein the drive mechanism is connected to displace the gripping means of the retaining centralizer between a gripping position and a releasing position.

3. An opening device according to claim 2, wherein the retaining centralizer is provided with a supporting sleeve rotatable by the drive mechanism and wherein the gripping means are mounted in the retaining centralizer and radially displaceably with respect to the supporting sleeve; said supporting sleeve provided with continuous, annular guideways for slidably displacing the gripping means between said gripping and releasing positions, said guideways being eccentric with respect to the axis of rotation of the supporting sleeve.

4. An opening device according to claim 1 wherein the gripping centralizer is mounted displaceably on a supporting rail and connected to said first actuating means for the displacement thereof along the supporting rail.

5. An opening device according to claim 4, wherein the supporting rail is mounted pivotably on the feeding beam and connected to a second actuating means for the displacement of the gripping centralizer toward and away from said drilling axis.

* * * * *